US006026615A

United States Patent [19]

Richardson

[11] Patent Number: 6,026,615

[45] Date of Patent: Feb. 22, 2000

[54] ROOFS

[75] Inventor: Christopher Richardson, Clitheroe, United Kingdom

[73] Assignee: Ultraframe Limited, United Kingdom

[21] Appl. No.: 09/127,747

[22] Filed: Aug. 3, 1998

[30] Foreign Application Priority Data

Dec. 29, 1997 [GB] United Kingdom ..... 9727334

[51] Int. Cl.[7] ..... E04B 7/00

[52] U.S. Cl. ..... 52/92.2; 52/94; 52/93.1; 52/90.1

[58] Field of Search ..... 52/731.7, 731.1, 52/92.2, 93.1, 94, 90.1, 204.57; 411/84, 104, 107

[56] References Cited

U.S. PATENT DOCUMENTS

| | | | |
|---|---|---|---|
| 1,985,333 | 12/1934 | Wiley | 411/107 |
| 4,261,143 | 4/1981 | Rizzo | 52/92 |
| 4,478,013 | 10/1984 | Tavano | 52/92 |
| 4,872,297 | 10/1989 | Hetzel et al. | 52/92 |
| 4,956,950 | 9/1990 | Hirose | 52/94 |

FOREIGN PATENT DOCUMENTS

| | | | |
|---|---|---|---|
| 0091894 A1 | 10/1983 | European Pat. Off. | 52/92 |
| 0345238 A1 | 5/1989 | European Pat. Off. | 52/92 |
| 2166770 | 5/1986 | United Kingdom | 52/92 |
| 2212183 | 7/1989 | United Kingdom | 52/92 |
| 2247474 | 3/1992 | United Kingdom | 52/92 |
| 2257726 | 1/1993 | United Kingdom | 52/92 |
| 2261447 | 5/1993 | United Kingdom | 52/92 |
| 2287048A | 9/1995 | United Kingdom . | |
| 2311308 | 9/1997 | United Kingdom | 52/92 |
| 2311308A | 9/1997 | United Kingdom . | |

OTHER PUBLICATIONS

Search Report of UK Patent Office, UK Patent Application No. GB 9826586.1 Date of search: Mar. 11, 1999.

*Primary Examiner*—Beth Aubrey
*Assistant Examiner*—Dennis L. Dorsey
*Attorney, Agent, or Firm*—Howell & Haferkamp, L.C.

[57] ABSTRACT

An eaves beam for use in constructing a conservatory roof has a channel therein for receiving a bolt for securing a glazing bar to the eaves beam, and a bolt received in the channel, the bolt having a head pivotable in the channel in order to vary the angle of a glazing bar secured by the bolt relative to the eaves beam.

15 Claims, 2 Drawing Sheets

ROOFS

BACKGROUND OF THE INVENTION

This invention concerns roofs and, in particular, concerns conservatory roofs.

Conservatory roofs are often constructed from polycarbonate roofing sheets supported between glazing bars. Special arrangements are required for, inter alia, eaves of such roofs.

It is known from GB Patent No. 2287048 to provide a roof structure comprising roofing sheets supported between glazing bars and having an eaves structure comprising an eaves beam adapted for securing glazing bars thereto at any desired angle, the eaves beam comprising first and second parts pivotable relative to each other, wherein one of said parts has a channel therein for retaining bolts which secure the glazing bars.

That eaves structure has been found to be relatively complicated to erect and so it is desirable to have a simpler system for constructing the eaves part of a roof.

SUMMARY OF THE INVENTION

According to the invention there is provided an eaves beam for use in constructing a roof, especially a conservatory roof, the eaves beam having a channel therein for receiving a bolt for securing a glazing bar to the eaves beam, the bolt having a head pivotable in said channel in order to vary the angle of the glazing bar relative to the eaves beam.

The invention further provides a roof structure comprising roofing sheets supported between glazing bars and having an eaves structure comprising an eaves beam having a channel therein for receiving a bolt for securing a glazing bar, the bolt having a head pivotable in said channel in order to vary the angle of the glazing bar relative to the eaves beam.

The eaves beam of the invention is preferably generally L-shaped in section providing a base and a side. The base of the eaves beam need only have a single wall. The base will generally be shaped for mounting on window frames forming the walls of a conservatory.

The side of the eaves beam is preferably twin walled. Preferably its intended inner wall is at right angles to the base but its outer wall is preferably spaced further from the inner wall at the base than at its top. The outer wall of the eaves beam is preferably at least partly arcuate.

The inner and outer side walls of the eaves beam may be connected by one or more webs.

At its top the eaves beam side has a head in which is provided the channel to receive the pivotable bolt.

The head of the eaves beam preferably has a top surface on which a glazing bar can rest at whatever angle it is secured to the eaves beam. The top surface of the head of the eaves beam preferably extends onto an outwardly directed flange and is preferably arcuate.

The bolt for use in the invention preferably has a head that has an arcuate top surface and a planar bottom surface from which extends a threaded shank onto which threaded nuts can be fitted to secure a glazing bar through which the shank has been fitted.

The channel of the eaves beam preferably has an arcuate concave base and a relatively narrow top opening. The bolt may be positioned as desired by sliding the head of the bolt along the eaves beam in the channel. When a glazing bar is secured by the bolt, the bolt can pivot to suit the desired angle for the glazing bar as determined by the pitch of the roof.

The side of the eaves beam preferably has on its intended inner face or wall means for attachment of cladding. For example, one or more fir-tree type ribs may be provided onto which slots of cladding can be push-fitted.

The outer face or wall of the eaves beam of the invention preferably has means for attachment of guttering or gutter supporting brackets. Again one or more fir-tree type ribs may be provided onto which slots of guttering or brackets therefor can be push-fitted.

BRIEF DESCRIPTION OF THE DRAWINGS

This invention will now be further described, by way of example only, with reference to the accompanying drawings, in which.

DETAILED DESCRIPTION OF THE INVENTION

Figure 1:
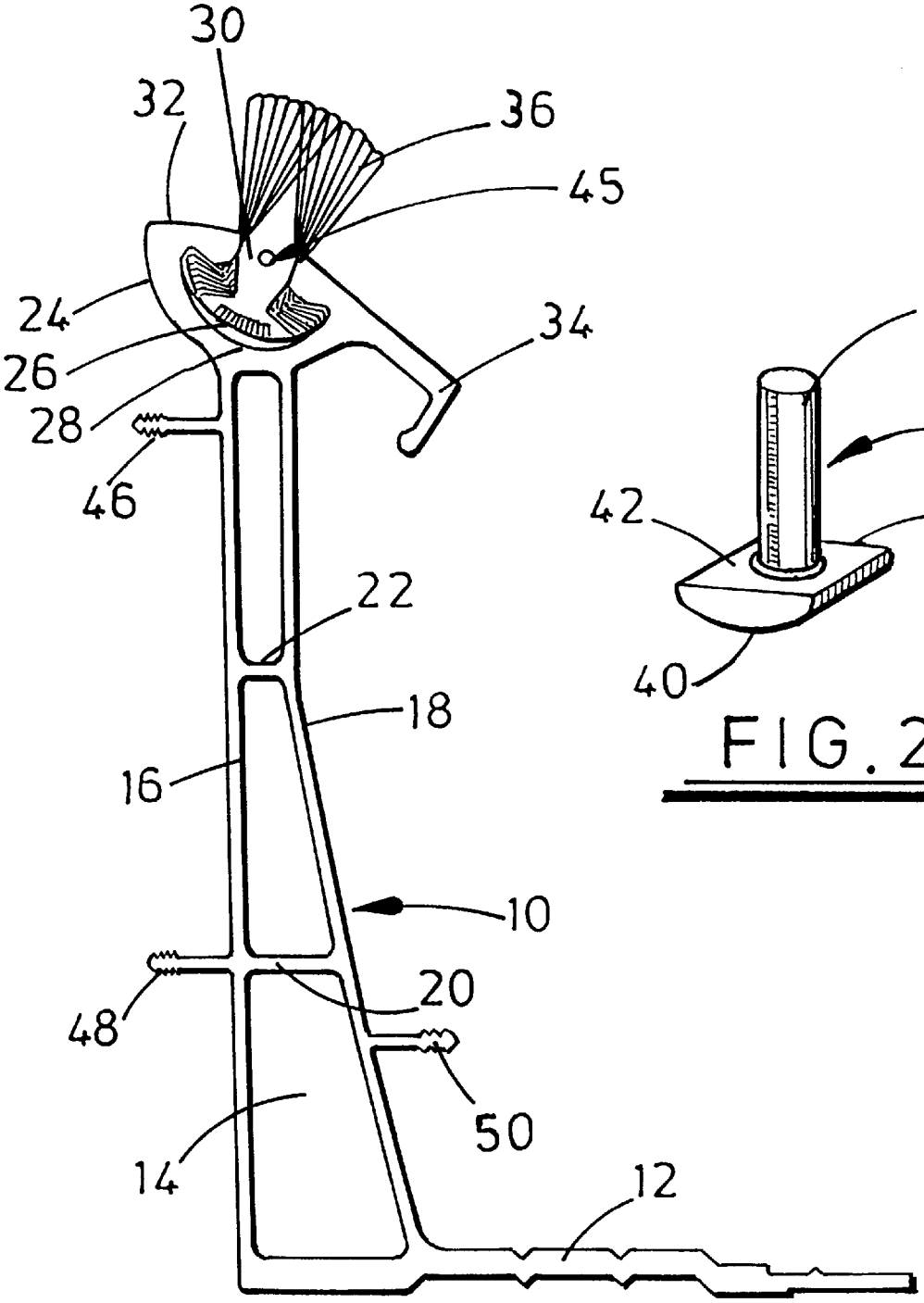
FIG. 1 shows an eaves beam with glazing bar securing bolt.
Figure 2:
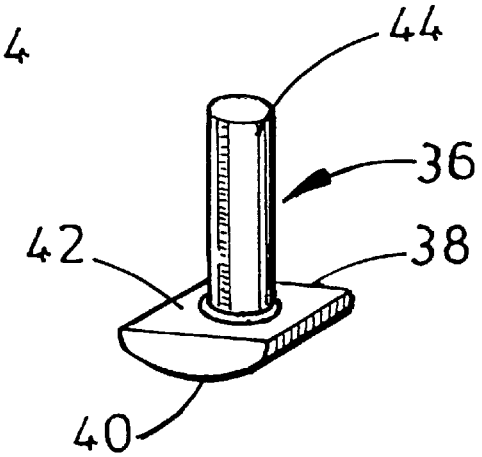
FIG. 2 shows the securing bolt.

Referring to the accompanying drawings, an eaves beam 10 for use in constructing a conservatory roof is extruded from aluminium. The eaves beam 10 is generally of L-section having a base 12 adapted for mounting on top of window frames forming the conservatory walls and an upstanding side 14.

The base 12 has a single wall whereas the side 14 is actually twin walled having an inner face 16 normal to the base and an outer face 18 that is generally arcuate and converges upwardly towards the inner face. The two faces 16, 18 are connected by webs 20, 22.

The inner face 16 has extending therefrom fir tree type ribs 46, 48 onto which plastics cladding can be fitted. The outer face 18 has extending therefrom a fir tree type rib 50 onto which guttering or gutter brackets can be fitted.

On top of the side 14 of the eaves beam is a head 24 having a channel 26 formed therein with an arcuate base 28 and a relatively narrow opening 30. The head 24 has a top surface 32 extending onto flange 34, the top surface 32 being generally arcuate.

The channel 26 is shaped to receive a head 38 of bolt 36, so that the bolt can pivot in the channel for securing a glazing bar at any desired angle relative to the eaves beam. The head 38 of the bolt has a top arcuate surface 40 and a planar bottom surface 42 from which extends screw-threaded shank 44. The shank 44 can rotate between about 5° and 40° to the vertical around notional rotation point 45.

Figure 3:
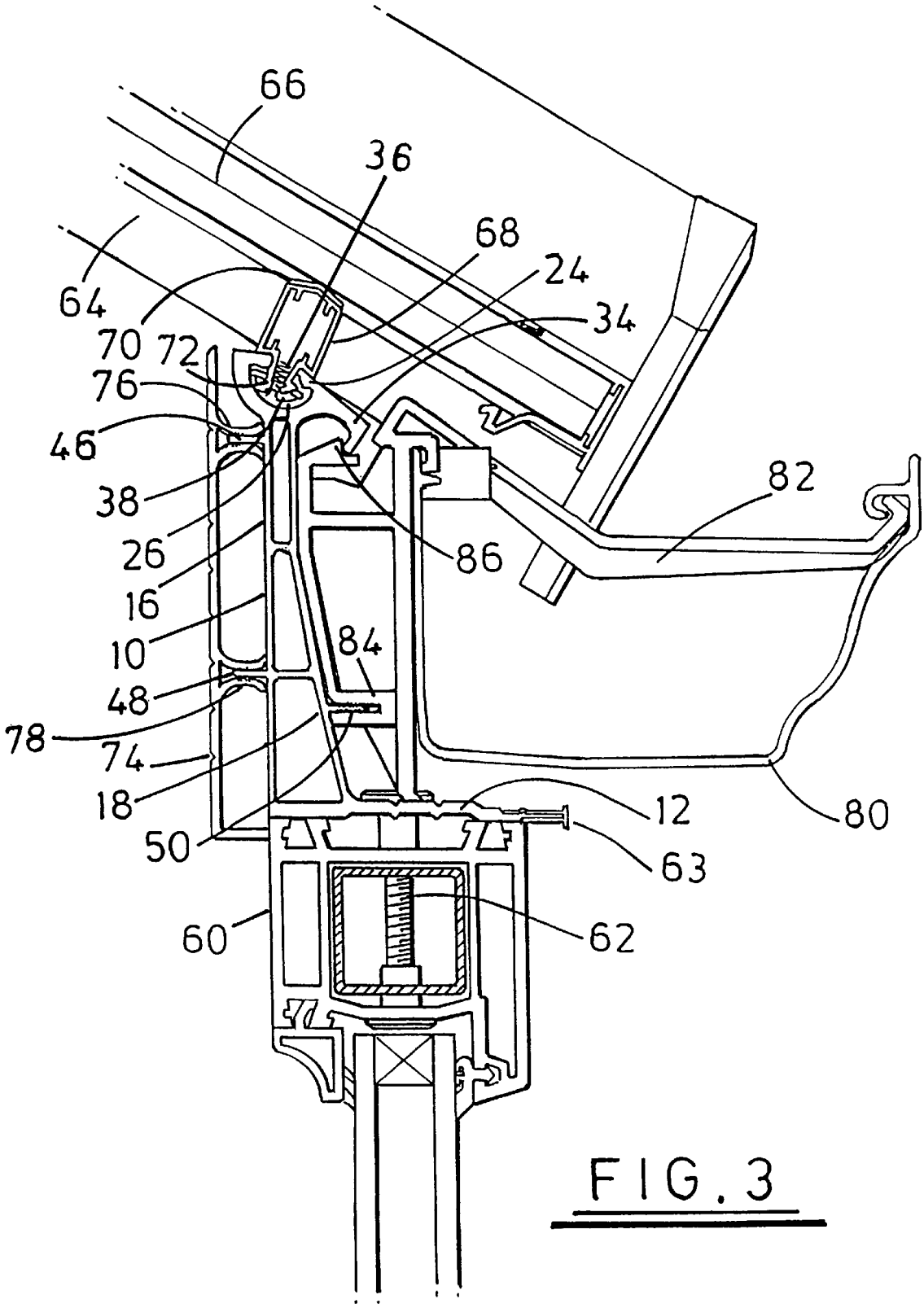
FIG. 3 is a general view of an eaves structure incorporating the eaves beam of FIG. 1.

FIG. 3 of the accompanying drawings show the eaves beam 10 as part of the eaves structure of a conservatory roof. The eaves beam 10 is mounted on top of window frame 66 which forms part of a side wall of the conservatory. Bolts 62 through the frame 60 and the base 12 of the eaves beam secure the eaves beam to the frame. The free end of the base 12 has a PVC cover trim 63 pushed onto it.

Secured to the pivotable bolt 36 are glazing bars 64 which support glazing panels 66. Between the bolts 36 extruded plastics trim 68 is provided. The trim has a top surface which bears a foam strip 70 that has an adhesive coating to seal onto the underside of the glazing panels. The trim has a bottom formation 72, whereby it clips into the channel 26 of the eaves beam.

Internal cladding 74 has slots 76, 78 that enable the cladding to be push-fitted onto the fir-tree ribs 46, 48 of the eaves beam 10. A gutter 80 is mounted in brackets 82 that are connected to the eaves beam by means of fir-tree rib 50 that fits a slot 84 of the bracket and a top return 86 of the bracket locates behind the free end of the flange 34 of the eaves beam.

I claim:

1. An eaves beam for use in constructing a roof, the eaves beam having a channel therein for receiving a bolt for securing a glazing bar to the eaves beam, and a bolt received in the channel, the bolt having a head pivotable in said channel in order to vary the angle of a glazing bar secured by the bolt relative to the eaves beam.

2. An eaves beam as claimed in claim 1, which is generally L-shaped in section having a base and an upstand.

3. An eaves beam as claimed in claim 2, wherein the base has a single wall.

4. An eaves beam as claimed in claim 2, wherein the upstand is twin walled providing an intended inner wall and an intended outer wall.

5. An eaves beam as claimed in claim 4, wherein the inner wall is at right angles to the base.

6. An eaves beam as claimed in claim 4, wherein the outer wall is spaced further from the inner wall at the base than at its top.

7. An eaves beam as claimed in claim 6, wherein the outer wall is at least partly arcuate.

8. An eaves beam as claimed in claim 4, wherein the intended inner and outer walls are connected by one or more webs.

9. An eaves beam as claimed in claim 1, wherein the eaves beam has a head in which is provided the channel to receive the pivotable bolt.

10. An eaves beam as claimed in claim 9, wherein the head has an arcuate top surface.

11. An eaves beam as claimed in claim 9, wherein the head extends onto an outwardly directed flange.

12. An eaves beam as claimed in claim 1, wherein the bolt has a head having an arcuate top surface and a planar bottom surface from which extends a threaded shank.

13. An eaves beam as claimed in claim 1, wherein the channel has an arcuate concave base and a relatively narrow top opening.

14. An eaves beam as claimed in claim 2, wherein the upstand has on its intended inner face means for attachment of cladding.

15. An eaves beam as claimed in claim 2, wherein the intended outer face of the upstand has means for attachment of one of guttering and guttering supporting brackets.

* * * * *